US006109883A

United States Patent [19]

Kawaguchi et al.

[11] Patent Number: 6,109,883

[45] Date of Patent: Aug. 29, 2000

[54] COUPLING CONSTRUCTION OF COMPRESSOR HOUSING AND METHOD FOR MANUFACTURING COMPRESSOR

[75] Inventors: Masahiro Kawaguchi; Yoshihiro Makino; Masanori Sonobe; Ken Suitou, all of Kariya, Japan

[73] Assignee: Kabushiki Kaisha Toyoda Jidoshokki Seisakusho, Kariya, Japan

[21] Appl. No.: 08/975,346

[22] Filed: Nov. 20, 1997

[30] Foreign Application Priority Data

Nov. 20, 1996 [JP] Japan ..... 8-309248

[51] Int. Cl.[7] ..... F04B 1/16

[52] U.S. Cl. ..... 417/269

[58] Field of Search ..... 417/269, 222.1, 417/222.2; 92/71; 91/499; 277/939, 944; D23/269

[56] References Cited

U.S. PATENT DOCUMENTS

| | | | |
|---|---|---|---|
| 96,654 | 9/1869 | Andrews | 277/939 |
| 4,190,402 | 2/1980 | Meece et al. | 417/415 |
| 4,544,332 | 10/1985 | Shibuya | 417/269 |
| 5,674,054 | 10/1997 | Ota et al. | 417/269 |
| 5,795,139 | 8/1998 | Ikeda et al. | 417/269 |
| 5,802,954 | 9/1998 | Ikeda et al. | 92/71 |

FOREIGN PATENT DOCUMENTS 1-257777 10/1989 Japan .

OTHER PUBLICATIONS

Merriam–Webster Collegiate Dictionary, 10th edition, Springfield, MA, p. 481, 1977.

*Primary Examiner*—Timothy S. Thorpe
*Assistant Examiner*—Ehud Gartenberg
*Attorney, Agent, or Firm*—Morgan & Finnegan, L.L.P.

[57] ABSTRACT

A compressor housing and method of manufacture and assembly are disclosed. The compressor housing includes a cylinder block and a front housing. An annular projection is formed on the front end of the cylinder block. An annular groove is formed on the rear end of the front housing. The cylinder block and the front housing are secured to each other to prevent the front housing from being displaced in relation to the cylinder block by engaging the annular projection with the annular groove. A gasket is located between the front end of the cylinder block and the rear end of the front housing secured to each other to seal between the cylinder block and the front housing. This compressor and its method of manufacture reduce the amount of misalignment between a shaft bore in the cylinder block and a shaft bore in the front housing, which improves the performance of the compressor.

13 Claims, 4 Drawing Sheets

COUPLING CONSTRUCTION OF COMPRESSOR HOUSING AND METHOD FOR MANUFACTURING COMPRESSOR

BACKGROUND OF THE INVENTION

The present invention relates to compressors including a gas compressing mechanism located in a chamber defined by a plurality of coupled housing elements. More specifically, the present invention pertains to a coupling structure for compressor housings and to a method for manufacturing and assembling compressors.

Swash plate type compressors are often used in vehicle air conditioners. The housing of a swash plate type compressor is generally constituted by a cylinder block, a front housing and a rear housing. The cylinder block has a plurality of cylinder bores. The front housing and the rear housing are secured to each end of the cylinder block with a sealing element such as an O-ring in between. A crank chamber is defined in the housing. The cylinder block has a shaft bore defined in the center portion. A radial bearing is located in the bore. The front housing also has a shaft bore defined in its center portion and a radial bearing located in the bore. A drive shaft extends through the crank chamber and is rotatably supported by the bearings located in the shaft bores of the cylinder block and the front housing. A swash plate is supported on the drive shaft in the crank chamber. The swash plate converts rotation of the drive shaft to reciprocation of pistons accommodated in the cylinder bores.

Accurate alignment of the axes of the shaft bores in the cylinder block and the front housing is required for smooth rotation of the drive shaft and accurate reciprocation of the pistons. Therefore, the front housing must be accurately positioned in relation to the cylinder block when joining the front housing with the cylinder block.

FIG. 5 shows one of the prior art methods for positioning a front housing in relation to a cylinder block. The method uses at least two positioning pins (only one is shown). As shown in FIG. 5, a pin hole 93 is formed in the upper portion and in the lower portion (only the pin hole in the upper portion is shown) of a cylinder block 92. The diameter of each pin hole 93 is substantially equal to that of the positioning pins 91. A front housing 94 has a pair of pin chambers 95, each corresponding to one of the pin holes 93 in the cylinder block 92. The diameter of the pin chambers 95 is larger than that of the pin holes 93.

When assembling the front housing 94 with the cylinder block 94, each pin 91 is arranged in a pair of the pin hole 93 and the pin chamber 95. A part of the inner wall 95*a* of each pin chamber 95 contacts the pin 91 and is aligned with a part of the inner wall 93*a* of the pin hole 93. The alignment determines the position of the front housing 94 in relation to the cylinder block 92.

However, the sizes of the positioning pins 91, the pin holes 93 and the pin chambers 95 have an error within a predetermined tolerance. When the front housing 94 is secured to the cylinder block 94 by using the positioning pins 91, the errors of the parts 91, 93, 95 are accumulated. The accumulation of the errors prevents an improvement in the positioning accuracy of the front housing 94 in relation to the cylinder block 92. In other words, the above prior art method, which uses the positioning pins 91, is not accurate enough to meet certain high standards.

O-rings are often used to seal between a cylinder block and a front housing. O-rings generally have standardized sizes and shapes. Therefore, when the design of a cylinder block and a front housing is changed, there may be no standard O-ring to conform to the changed cylinder block and front housing. Further, a groove must be formed in the end face of a cylinder block or of a front housing for accommodating an O-ring. These disadvantageous characteristics of O-rings have raised a need for a new type of a sealing member that conforms to changes in the size and shape of the cylinder block and the front housing.

SUMMARY OF THE INVENTION

Accordingly, it is an objective of the present invention to provide a method and apparatus for coupling compressor housing members and a method for manufacturing compressors that improve the accuracy of positioning of housing members in relation to each other and the accuracy of positioning of a sealing element and prevent the sealing element from being displaced from its original position.

To achieve the above objective, the compressor housing according to the present invention includes a first housing element and a second housing element. Each housing element has an end wall secured to the other housing element. A gas compression mechanism is located between the first and second housing elements. A projection is formed on the end wall of one of the first and second housing elements. A recess is formed on the end wall of the other of the first and second housing elements. The recess has a shape corresponding to the shape of the projection. The first and second housing elements are secured to each other to prevent the housing elements from being displaced in relation to each other by engaging the projection with the recess. A gasket is located between the end walls of the housing elements to seal between the housing elements.

In a second aspect of the present invention, a method for manufacturing a compressor is provided. A compressor housing includes a first housing element and a second housing element. Each housing element has an end wall secured to the other housing element. A gas compression mechanism, which has a drive shaft, is located in a chamber defined between the first and second housing elements. The method comprises the steps of: forming a projection on the end wall of one of the first and second housing elements; forming a recess on the end wall of the other of the first and second housing elements, wherein the recess has a shape corresponding to the shape of the projection; securing the first and second housing elements to each other to prevent the housing elements from being displaced in relation to each other by engaging the projection with the recess; forming shaft bores, which are used for supporting the drive shaft, in the housing elements, while the housing elements are secured to each other; separating the housing elements from each other to place the compression mechanism between the housing elements; and securing the housing elements to each other again, wherein a gasket is located between the end walls of the housing elements to seal between the housing elements when the housing elements are assembled.

In a third aspect of the present invention, a further method for manufacturing a compressor is provided. The method comprises the steps of: forming a projection on the end wall of one of the first and second housing elements; forming a recess on the end wall of the other of the first and second housing elements, wherein the recess has a shape corresponding to the shape of the projection; machining a shaft bore, which is used for supporting the drive shaft, in one of the housing elements, while the housing elements are separated; machining a shaft bore, which is used for supporting the drive shaft, in the other of the housing elements, while the housing elements are separated; placing the compression mechanism between the housing elements; and securing the first and second housing elements to each other to prevent the housing elements from being displaced in relation to each other by engaging the projection with the recess, wherein a gasket is located between the end walls of the housing elements to seal between the housing elements when the housing elements are assembled.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings.

DETAILED DESCRIPTION OF THE PREFERRED EMBODIMENTS

A preferred embodiment of a swash plate type variable displacement compressor according to the present invention will hereafter be described with reference to drawings.

Figure 1:
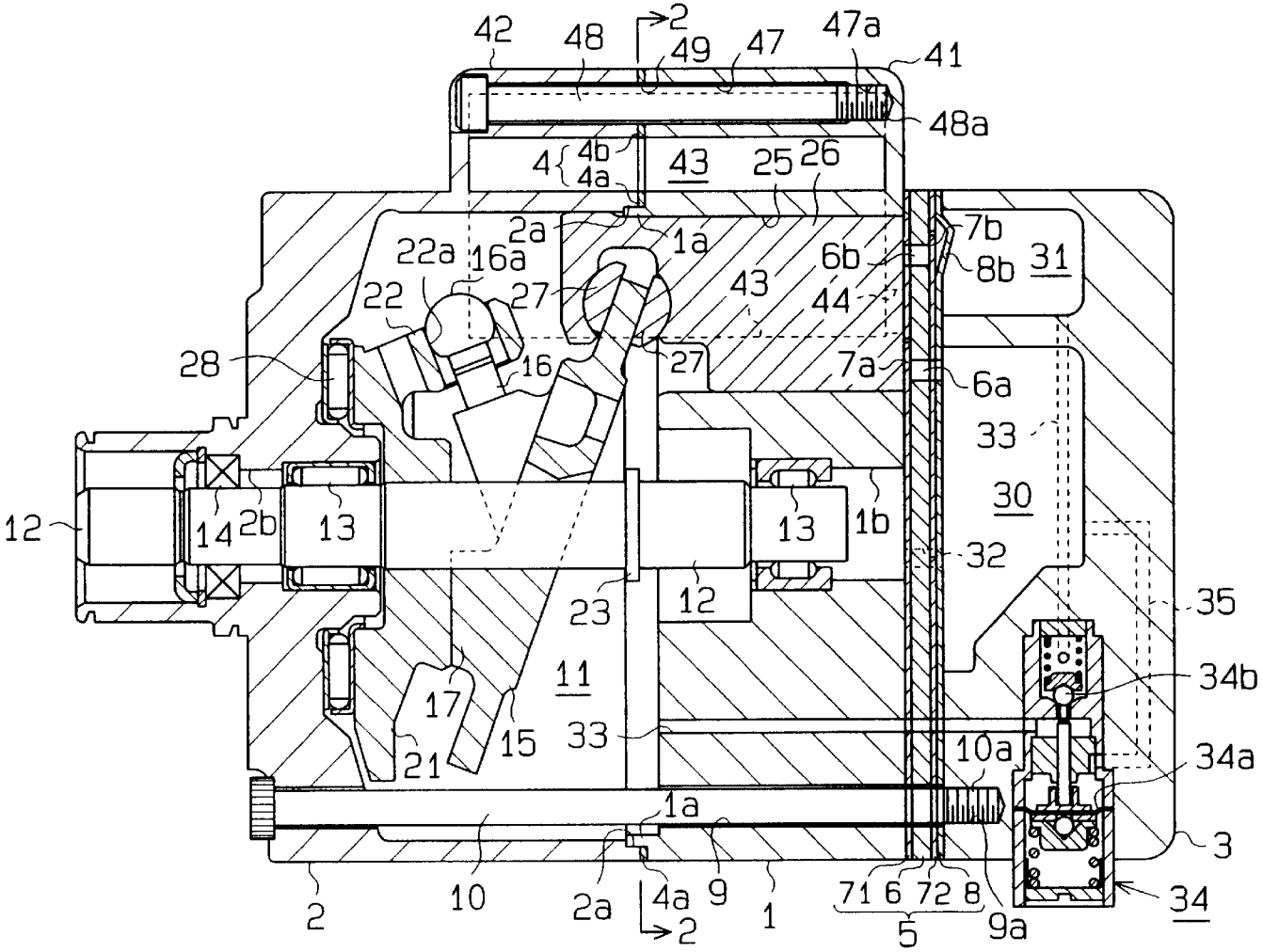
FIG. 1 is a cross-sectional view of a swash plate type compressor according to a preferred embodiment of the present invention.

As shown in FIG. 1, a cylinder block 1 constitutes a part of the compressor housing. A front housing 2 is secured to the front end face of a cylinder block 1 with a gasket 4 in between. A rear housing 3 is secured to the rear end face of the cylinder block 1 with a valve mechanism 5. The valve mechanism 5 includes a valve plate 6, a first plate 71, a second plate 72 and a third plate 8.

Figure 2:
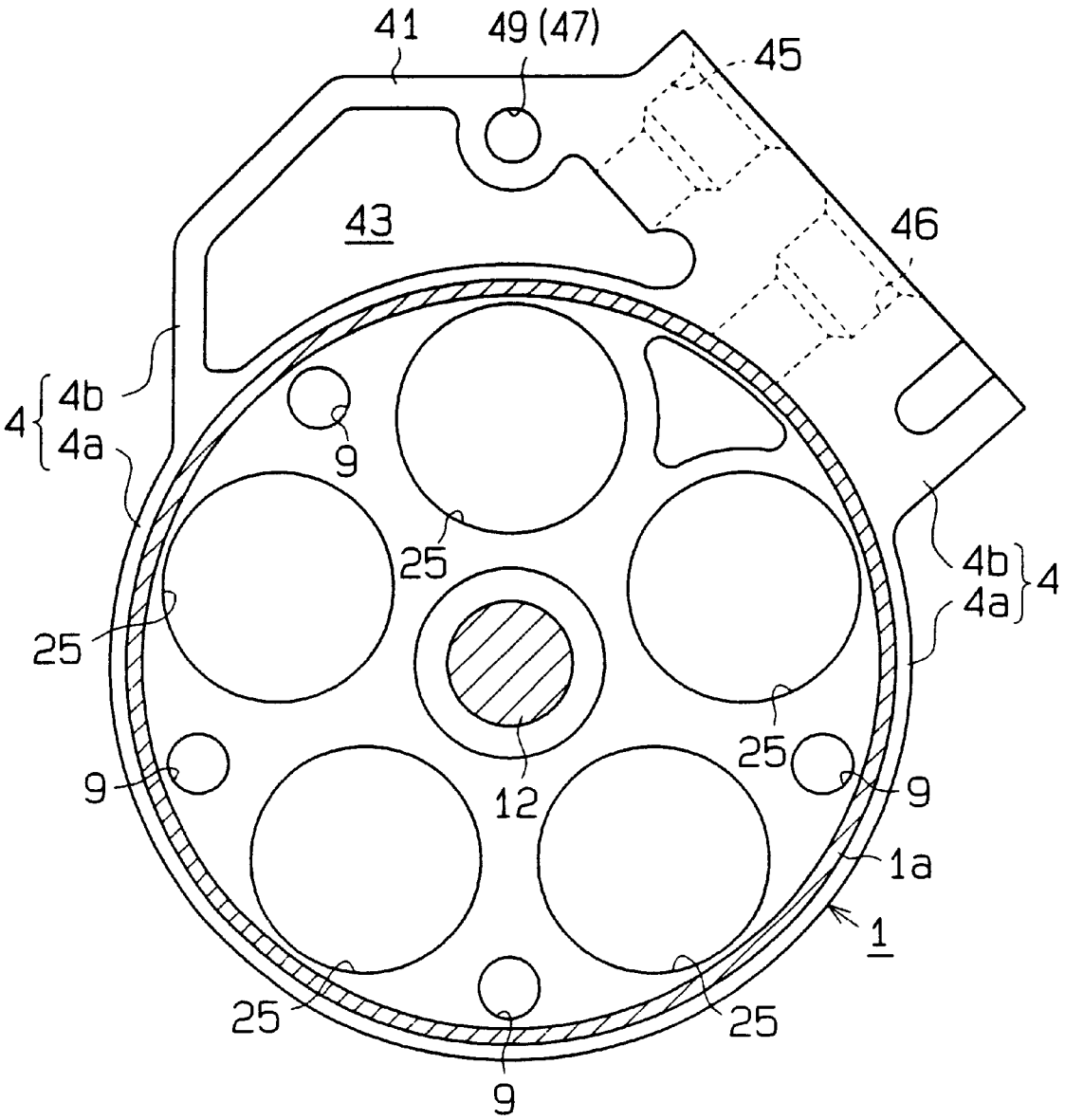
FIG. 2 is a cross-sectional view taken along line 2—2 of FIG. 1.

As shown in FIGS. 1 and 2, a plurality of first through holes 9 extend through the front housing 2, the cylinder block 1, the valve mechanism 5 and the rear housing 3. A threaded hole 9*a* is formed in a part of each first through hole 9 located in the rear housing 3. A first bolt 10 having a threaded portion 10*a* on its distal end is inserted in each first hole 9 from the front housing 2. Each threaded portion 10*a* is screwed into the corresponding threaded hole 9*a*. In this manner, the front housing 2 and the rear housing 3 are secured to the cylinder block 1 by the bolts 10.

The cylinder block 1 and the front housing 2 are secured to each other by engaging a projection and a groove. That is, an annular projection la is formed on the front end of the cylinder block 1 and an annular groove 2*a* is formed in the rear end of the front housing 2. The groove 2*a* is engaged with the projection 1*a*. The gasket 4 has an annular portion 4*a* surrounding the projection 1*a*. The inner surface of the annular portion 4*a* is engaged with the periphery of the projection 1*a*, which prevents the gasket 4 from being laterally displaced in relation to the cylinder block 1. Fastening of the first bolts 10 causes the annular portion 4*a* of the gasket 4 to be held about the projection 1*a* between the cylinder block 1 and the front housing 2.

As shown in FIG. 1, a crank chamber 11 is defined by the inner walls of the front housing 2 and the front end face of the cylinder block 1. A shaft bore 1*b* is formed in the center of the cylinder block 1. The rear end of a drive shaft 12 is inserted in the shaft bore 1*b*. The front housing 2 also has a shaft bore 2*b* formed in its center. A front portion of the drive shaft 12 extends through the shaft bore 2*b*. Radial bearings 13 are located in each of the shaft bores 1*b* and 2*b*. The bearings 13 rotatably support the drive shaft 12.

An annular lip seal 14 is located between the front portion of the drive shaft 12 and the inner wall of the shaft bore 2*b* in the front housing 2. The lip seal 14 prevents gas in the crank chamber 11 from leaking. The front end of the drive shaft 12 is operably coupled to an external drive source such as a vehicle engine by an electromagnetic clutch (not shown). When the clutch connects the drive shaft 12 with the drive source, the force of the drive source is transmitted to the drive shaft 12.

A rotor 21 is fixed to the drive shaft 12 in the crank chamber 11. The rotor 21 rotates integrally with the drive shaft 12. A swash plate 15 is supported by the drive shaft 12 in the crank chamber 11 to be slidable along and tiltable with respect to the axis of the shaft 12. The rotor 21 has a pair of support arms 22 (only one is shown) protruding toward the swash plate 15. A guide hole 22*a* is formed in each support arm 22. A pair of guide pins 16 (only one is shown) are formed on the swash plate 15. Each guide pin 16 has guide ball 16*a* at the distal end. Each guide ball 16*a* is slidably fitted into the guide hole 22*a* of the corresponding support arm 22.

The cooperation of the arms 22 and the guide pins 16 permits the swash plate 15 to rotate together with the drive shaft 12. The cooperation also guides the tilting of the swash plate 15 and the movement of the swash plate 15 along the axis of the drive shaft 12. As the swash plate 15 slides rearward toward the cylinder block 1, the inclination of the swash plate 15 decreases. A ring shaped stopper 23 is fixed on the drive shaft 12 in the vicinity of the cylinder block 1. The abutment of the swash plate 15 against the stopper 23 prevents the inclination of the swash plate 15 from being less than a predetermined minimum inclination. A projection 17 is formed on the front face of the swash plate 15. The abutment of the projection 17 against the rear face of the rotor 21 prevents the inclination of the swash plate 15 from increasing beyond a predetermined maximum inclination.

As shown in FIGS. 1 and 2, a plurality of cylinder bores 25 (five in this embodiment) extend parallel to and about the drive shaft 12 through the cylinder block 1. A single-headed piston 26 is accommodated in each cylinder bore 25. Compression chambers are defined in each cylinder bore 25 between the end of the piston 26 and the valve mechanism 5. Each piston 26 is operably coupled to the swash plate 15 by a pair of shoes 27. Rotation of the drive shaft 12 is converted to linear reciprocation of each piston 26 in the associated cylinder bore 25 through the swash plate 15 and the shoes 27.

As shown in FIG. 1, a suction chamber 30 is defined in the center portion of the rear housing 3. A substantially circular discharge chamber 31 is defined about the suction chamber 30 in the rear housing 3. Suction ports 6*a* and discharge ports 6*b* are formed in the valve plate 6. Each suction port 6*a* and each discharge port 6*b* correspond to one of the cylinder bores 25. Suction valve flaps 7*a* are formed on the first plate 71. Each suction valve flap 7*a* corresponds to one of the suction ports 6*a*. Discharge valve flaps 7*b* are formed on the second plate 72. Each discharge valve flap 7*b* corresponds to one of the discharge ports 6*b*.

Refrigerant gas in an external refrigerant circuit (not shown) is drawn into the suction chamber 30 through an inlet 46 (see FIG. 2). As each piston 26 moves from the top dead center to the bottom dead center in the associated cylinder bore 25, refrigerant gas in the suction chamber 30 is drawn into the cylinder bore 25 through the associated suction port 6*a* while causing the associated suction valve flap 7*a* to flex to an open position. As each piston 26 moves from the bottom dead center to the top dead center in the associated cylinder bore 25, refrigerant gas is compressed in the cylinder bore 25 and discharged to the discharge chamber 31 through the associated discharge port 6*b* while causing the associated discharge valve flap 7*b* to flex to an open position. Retainers 8*b* are formed on the third plate 8. The opening amount of each discharge valve flap 7*b* is defined by contact between the valve flap 7*b* and the associated retainer 8*b*.

A thrust bearing 28 is located between the front housing 2 and the rotor 21. The thrust bearing 28 carries the reactive force of gas compression acting on the rotor 21 through the pistons 26 and the swash plate 15.

A pressure release hole 32 is formed in the valve mechanism 5 for communicating the suction chamber 30 with the crank chamber 11 via the shaft bore 1*b*. A pressure supply passage 33 is defined in the cylinder block 1, the valve mechanism 5 and the rear housing 3 for communicating the discharge chamber 31 with the crank chamber 11. A displacement control valve 34 is accommodated in the rear housing 3 in the supply passage 33. A pressure introducing passage 35 is defined in the rear housing 3 for communicating the pressure in the suction chamber 30 with the displacement control valve 34. The valve 34 includes a valve body 34*a* and a diaphragm 34*a*. The diaphragm 34*a* moves the valve body 34*b* in accordance with the pressure of the suction chamber 30, which is communicated with the diaphragm 34*a* by the passage 35. Accordingly, the valve body 34*b* controls the opening of the supply passage 33.

In this manner, the flow rate of refrigerant gas from the discharge chamber 31 to the crank chamber 11 through the supply passage 33 is controlled by the displacement control valve 34. The pressure in the crank chamber 11 is changed, accordingly. Changes in the crank chamber pressure alter the difference between the pressure in the crank chamber 11 acting on the rear face of the pistons 26 (the left face as viewed in FIG. 1) and the pressure in the cylinder bore 25 acting on the front face of the pistons 26 (the right face as viewed in FIG. 1). This changes the inclination of the swash plate 15 and thus changes the stroke of the pistons 26. Consequently, the displacement of the compressor is changed.

As shown in FIGS. 1 an 2, a rear muffler housing 41 is integrally formed on the top of the cylinder block 1. A front muffler housing 42 is integrally formed on the top of the front housing 2. A second through hole 47 extends through the front muffler housing 42 and the rear muffler housing 41. A muffler seal portion 4*b* of the gasket 4 is located between the muffler housings 41 and 42, and a second bolt 48 is inserted into the second through hole 47 from the front muffler housing 42. A threaded portion 48*a* is formed on the distal end of the second bolt 48 and is screwed in a threaded hole 47*a* formed in a part of the second through hole 47 located in the rear muffler housing 41. Therefore, the cylinder block 1 and the front housing 2 are secured to each other with the muffler seal portion 4*b* of the gasket 4 held between the muffler housings 42 and 41. The muffler housings 41, 42 define a muffler chamber 43 in between.

The muffler chamber 43 is communicated with the discharge chamber 31 by a passage 44 and is connected to the external refrigerant circuit by an outlet 45 formed in the rear muffler housing 41. Refrigerant gas that is compressed in the cylinder bores 25 is discharged to the discharge chamber 31. The gas is guided into the muffler chamber 43 by the passage 44. The muffler chamber 43 suppresses the discharge pulsation of the compressed gas. The gas in the muffler chamber 43 is discharged to the refrigerant circuit through the outlet 45.

As described above, the gasket 4 includes the annular portion 4*a*, which has a shape corresponding to the shape of the ends of the cylinder block 1 and the front housing 2, and the muffler seal portion 4*b*, which has a shape corresponding to the shape of the muffler housings 41, 42. The gasket 4 is made of, for example, a thin metal plate covered with an elastic material such as a synthetic rubber. The gasket 4 not only seals between the cylinder block 1 and the front housing 2 but also seals between the muffler housings 41 and 42. The second bolt 48 is inserted in a hole 49 formed in the muffler seal portion 4*b* and prevents the annular portion 4*a* from rotating about the annular projection 1*a* of the cylinder block 1.

Two methods for manufacturing and assembling the cylinder block 1 and the front housing 2 will now be described.

Figure 3:
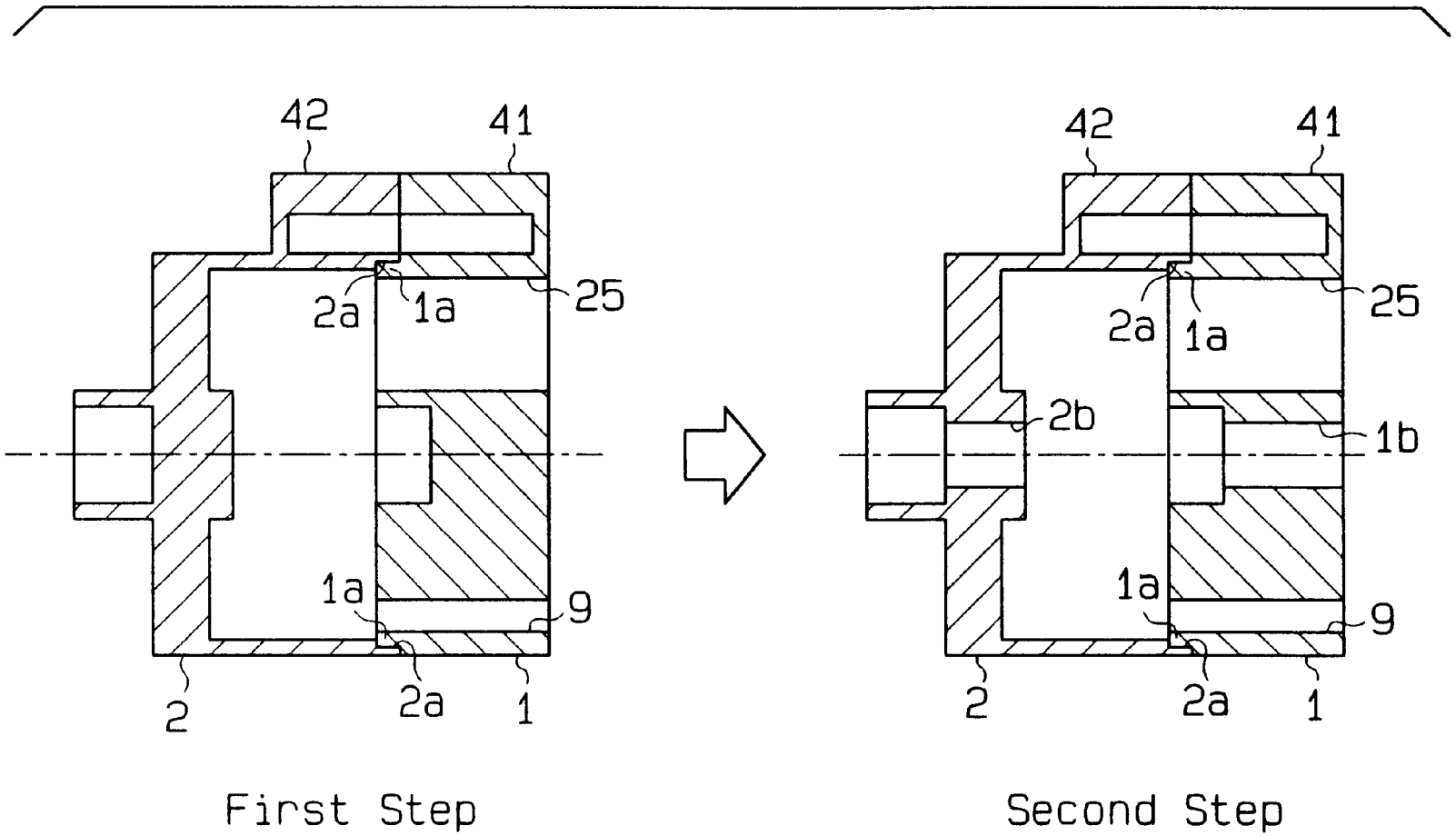
FIG. 3 is a cross-sectional view illustrating a first method for assembling a compressor housing.

FIG. 3 illustrates a first method. Initially, a cylinder block 1, in which the shaft bore 1*b* has not yet been formed, and the front housing 2, in which the shaft bore 2*b* has not yet been formed, are prepared. Then, the cylinder block 1 and the front housing 2 are fitted to each other by engaging the annular projection 1*a* of the cylinder block 1 with the annular groove 2*a* of the front housing 2. Then, the shaft bores 1*b* and 2*b* are drilled in the centers of the cylinder block 1 and the front housing 2 simultaneously by a drilling machine (not shown). In other words, the shaft bores 1*b*, 2*b* are drilled together by the same drill in a single drilling step. In this manner, manufacturing of the cylinder block 1 and the front housing 2 is completed.

After drilling, the cylinder block 1 and the front housing 2 are temporarily separated. Then, the compression mechanism, including the drive shaft 12 and swash plate 15, is placed in the crank chamber 11. Thereafter, the cylinder block 1 and the front housing 2 are fitted to each other again with the gasket 4 in between. The cylinder block 1 and the front housing 2 are secured to each other by the bolts 10 and 48. The assembly of the compressor is thus completed.

Figure 4:
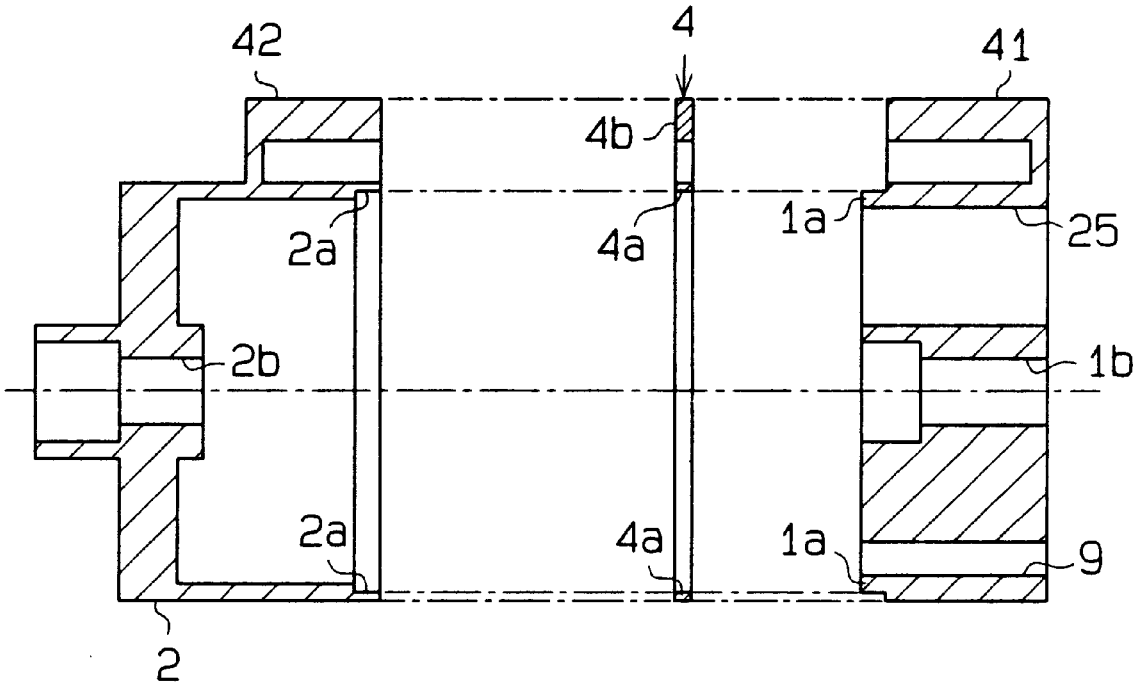
FIG. 4 is a cross-sectional view illustrating a second method for assembling a compressor housing.

FIG. 4 illustrates a second method. In this method, the shaft bores 1*b* and 2*b* are each formed in the cylinder block 1 and the front housing 2 in a different step, without fitting the cylinder block 1 and the front housing 2 to each other. Then, the compression mechanism, including the drive shaft 12 and the swash plate 15, is placed in the crank chamber 11. Thereafter, the cylinder block 1 is engaged with the front housing 2 with the gasket 4 in between. The cylinder block 1 and the front housing 2 are fastened to each other by the bolts 10, 48. The assembly of the compressor is thus completed.

Experiments using the first and second methods were performed using prototype compressors. The experiments revealed that the misalignment, or error, between the axis of the shaft bore 1*b* formed in the cylinder block 1 and the axis of the shaft bore 2*b* formed in the front housing 2 is smaller in the methods of FIGS. 3 and 4 than in the prior art method (see FIG. 5), which uses two positioning pins. Obviously, a smaller error between the shaft bores 1*b* and 2*b* is desirable.

In the experiments, three cylinder blocks 1 of the same shape and size and three front housings 2 of the same shape and size were prepared. They were assembled by the method of FIG. 3, the method of FIG. 4 and the prior art method. In the method shown in FIG. 3, the misalignment between the axis of the shaft bore 1*b* in the cylinder block 1 and the axis of the shaft bore 2*b* in the front housing 2 was 0.035 mm. In the method shown in FIG. 4, the misalignment between the axes of the shaft bores 1*b* and 2*b* was 0.100 mm. In the prior art method, the misalignment between the axes of the shaft bores 1*b* and 2*b* was 0.324 mm.

As described above, the cylinder block 1 and the front housing 2 are secured to each other by engaging a projection with a groove in the first and second methods. The methods of FIGS. 3 and 4 reduced the misalignment of the axes of the shaft bores 1*b* and 2*b* to levels smaller than the that of the prior art method. In the method of FIG. 4, the misalignment is slightly larger than that of the method of FIG. 3. However, a misalignment of about 0.100 mm is small enough to be within an acceptable tolerance in assembling compressors and does not hinder the operation of a compressor.

The above apparatus and methods have the following advantages.

Figure 5:
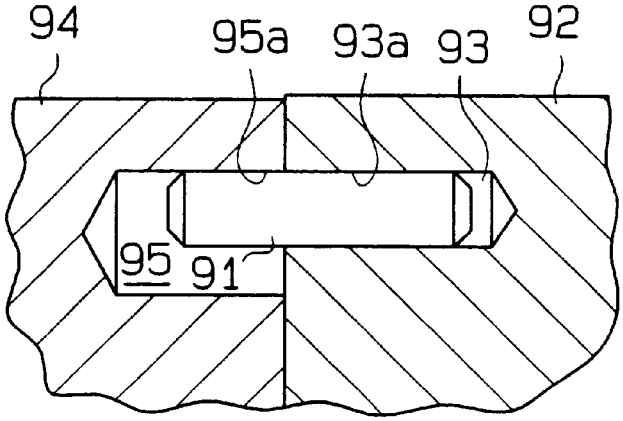
Fig.5(Prior Art)
FIG. 5 is an enlarged partial cross-sectional view illustrating a prior method for assembling a compressor housing.

The method shown in FIG. 3 and the method shown in FIG. 4 improve the accuracy of the assembly of the cylinder block 1 and the front housing 2 compared to the method of the prior art shown in FIG. 5. The methods of FIGS. 3 and 4 match the axes of the shaft bores 1*b* and 2*b* with a high accuracy thereby optimizing the position of the drive shaft 12. That is, the preferred and illustrated methods allow the drive shaft 12 to be supported by the radial bearing 13 at an almost ideal position. Thus, the shaft 12 is smoothly rotated. Further, the preferred and illustrated methods allow the swash plate 15 to be smoothly and accurately tilted and allow the pistons 26 to be accurately reciprocated in the cylinder bores 25. The operation of the compressor is therefore improved.

The inner surface of the annular portion 4*a* of the gasket 4 is engaged with the outer surface of the annular projection 1*a* of the cylinder block 1. This engagement allows the position of the gasket 4 to be easily and securely determined in relation to the cylinder block 1 and prevents the gasket 4 from being displaced from the determined position.

O-rings are often used as a sealing element located between two parts in a compressor. The O-rings generally have standardized sizes and shapes. Therefore, when the design of the cylinder block 1 and the front housing 2 is changed, there may not be a standard O-ring to conform to the changed size and shape of the cylinder block 1 and the front housing. 2. Further, a groove must be formed in the end face of the cylinder block 1 or of the front housing 2 for accommodating an O-ring. However, the shape of gasket 4, which is used in the embodiments of FIGS. 3 and 4, is easy to change in accordance with the shape of a part that requires sealing. Use of the gasket 4 gives a greater flexibility to designing of compressor housings compared to use of an O-ring. This is a great advantage in designing a compressor housing in which the muffler housings 41, 42 are integrally formed in the cylinder block 1 and the front housing 2.

In the method shown in FIG. 4, the displacement between the axes of the shaft bores 1*b* and 2*b* is slightly greater than that of the method shown in FIG. 3. However, the shaft bore 1*b* in the cylinder block 1 and the shaft bore 2*b* in the front housing 2 are each formed in a different step. Therefore, if either of the cylinder block 1 or the front housing 2 has a dimensional error, only the part that has the error is re-machined or replaced. The method of FIG. 4 thus reduces the fraction of defective compressor housings and is therefore suitable for large quantity production of compressors.

It should be apparent to those skilled in the art that the present invention may be embodied in many other specific forms without departing from the spirit or scope of the invention. Particularly, it should be understood that the invention may be embodied in the following forms.

In the embodiment of FIGS. 1–4, the annular projection 1*a* is formed on the cylinder block 1 and the annular groove 2*a* is formed in the front housing 2. However, the annular groove may be formed in the cylinder block 1 and the annular projection may be formed on the front housing 2.

The annular projection 1*a* is a continuous projection in the embodiment of FIGS. 1–4. However, the projection 1*a* may be divided into multiple parts. That is, a plurality of arcuate projections may be formed on the cylinder block 1 to form a generally annular set of projections.

The present invention is embodied in a variable displacement swash plate type compressor having single headed pistons. However, the present invention may be embodied in any type of compressor. For example, the present invention may be embodied in a fixed displacement compressor or a swash plate type compressor having double-headed pistons. Also, the present invention may be embodied in a wave cam type compressor having a wave cam instead of a swash plate. Further, the present invention may be embodied in other non-piston compressors. For example, the present invention may be embodied in rotary type compressors (vane type compressors and scroll type compressors).

Therefore, the present examples and embodiments are to be considered as illustrative and not restrictive and the invention is not to be limited to the details given herein, but may be modified within the scope and equivalence of the appended claims.

What is claimed is:

1. A compressor housing having an axis, wherein the compressor housing includes a first housing element and a second housing element, wherein each housing element has an annular end wall secured to the other housing element, and wherein a gas compression mechanism is located between the first and second housing elements, the compressor housing comprising:

an annular projection formed on the end wall of one of the first and second housing elements;

an annular recess formed on the end wall of the other of the first and second housing elements, wherein the recess has a shape corresponding to the shape of the projection, and wherein the first and second housing elements are secured to each other to prevent the housing elements from being displaced in relation to each other by engaging the projection with the recess; and a gasket having an annular portion surrounding the annular projection wherein the inner surface of annular portion of the gasket is engaged with the periphery of the annular projection, said gasket sandwiched by a force in the axial direction of the compressor housing between the end walls of the housing elements to seal between the housing elements when the housing elements are assembled.

2. The compressor housing according to claim 1 further comprising:

a muffler housing element integrally formed on each housing element, wherein a muffler chamber for suppressing the pulsation of gas discharged from the compression mechanism is defined between the muffler housing elements when the first and second housing elements are assembled;

a muffler seal portion provided on the gasket, wherein the muffler seal portion is located between the muffler housing elements to seal therebetween; and a bolt inserted through the muffler housing elements to fix the muffler housing elements to each other, wherein the muffler seal portion has a hole through which the bolt is inserted, and wherein the bolt prevents the annular portion of the gasket from rotating about the projection.

3. The compressor housing according to claim 1, wherein each housing element is integrally provided with a muffler housing element, and wherein a muffler chamber for suppressing the pulsation of gas discharged from the compression mechanism is defined between the muffler housing elements when the first and second housing elements are assembled.

4. The compressor housing according to claim 3, wherein the gasket includes a muffler seal portion located between the muffler housing elements to seal therebetween.

5. The compressor housing according to claim 1, wherein the compression mechanism includes a drive shaft rotatably supported in the housing elements, a drive plate mounted on the drive shaft, and a piston operably coupled to the drive plate, wherein the first housing element is a cylinder block having a cylinder bore for slidably accommodated the piston, wherein the second housing element is a front housing having an internal space for accommodating the compression mechanism, and wherein the cylinder block and the front housing each have shaft bores for supporting the drive shaft.

6. A compressor housing, wherein the compressor housing includes a cylinder block and a front housing, wherein the cylinder block has an annular end wall secured to the front housing, wherein the front housing has an annular end wall secured to the cylinder block, and wherein a gas compression mechanism is located in a crank chamber defined between the cylinder block and the front housing, the compressor housing comprising:

an annular projection extending along the end wall of the cylinder block;

an annular recess extending along the end wall of the front housing, wherein the annular recess has a shape corresponding to the shape of the annular projection, and wherein the cylinder block and the front housing are secured to each other to prevent the front housing from being displaced in relation to the cylinder block by engaging the annular projection with the annular recess;

a gasket located between the end wall of the cylinder block and the end wall of the front housing to seal between the cylinder block and the front housing, wherein the gasket includes an annular portion engaged with the periphery of the annular projection;

muffler housing elements integrally formed on the cylinder block and the front housing, respectively, wherein a muffler chamber for suppressing the pulsation of gas discharged from the compression mechanism is defined between the muffler housing elements when the cylinder block and the front housing are assembled;

a muffler seal portion provided on the gasket, wherein the muffler seal portion is located between the muffler housing elements to seal therebetween; and a bolt inserted though the muffler housing elements to fix the muffler housing elements to each other, wherein the muffler seal portion has a hole through which the bolt is inserted, and wherein the bolt prevents the annular portion of the gasket from rotating about the annular projection.

7. A method for manufacturing a compressor, wherein a compressor housing includes a first housing element and a second housing element, wherein each housing element has an annular end wall secured to the other housing element, and wherein a gas compression mechanism, which has a drive shaft, is located in a chamber defined between the first and second housing elements, the method comprising the steps of:

forming an annular projection on the end wall of one of the first and second housing elements;

forming an annular recess on the end wall of the other of the first and second housing elements, wherein the recess has a shape corresponding to the shape of the projection;

securing the first and second housing elements to each other to prevent the housing elements from being displaced in relation to each other by engaging the annular projection with the annular recess;

forming shaft bores, which are used for supporting the drive shaft, in the housing elements, while the housing elements are secured to each other;

separating the housing elements from each other to place the compression mechanism between the housing elements; and securing the housing elements to each other again, wherein a gasket is located between the end walls of the housing elements to seal between the housing elements when the housing elements are assembled.

8. The method according to claim 7, wherein the shaft bores are formed by drilling them at the same time with the same drill.

9. A method for manufacturing a compressor, wherein a compressor housing includes a first housing element and a second housing element, wherein each housing element has an annular end wall secured to the other housing element, and wherein a gas compression mechanism, which has a drive shaft, is located in a chamber defined between the first and second housing elements, the method comprising the steps of:

forming an annular projection on the end wall of one of the first and second housing elements;

forming an annular recess on the end wall of the other of the first and second housing elements, wherein the recess has a shape corresponding to the shape of the projection;

machining a shaft bore, which is used for supporting the drive shaft, in one of the housing elements, while the housing elements are separated;

machining a shaft bore, which is used for supporting the drive shaft, in the other of the housing elements, while the housing elements are separated;

placing the compression mechanism between the housing elements; and securing the first and second housing elements to each other to prevent the housing elements from being displaced in relation to each other by engaging the annular projection with the annular recess, wherein a gasket is located between the end walls of the housing elements to seal between the housing elements when the housing elements are assembled.

10. The compressor housing according to claim 1 further comprising a restrictor for restricting rotation of the annular portion of the gasket about the projection.

11. The compressor housing according to claim 10, wherein the restrictor is a bolt for fixing the housing elements to each other.

12. The compressor housing according to claim 1, wherein the end wall of each housing element has a flat surface, and wherein the flat surfaces of the housing elements sandwich and hold the gasket therebetween when the housing elements are assembled.

13. The compressor housing according to claim 1, wherein the gasket comprises a metal plate covered with an elastic material.

* * * * *

UNITED STATES PATENT AND TRADEMARK OFFICE

CERTIFICATE OF CORRECTION

PATENT NO. : 6,109,883
DATED : August 29, 2000
INVENTOR(S) : Kawaguchi et al.

It is certified that error appears in the above-identified patent and that said Letters Patent is hereby corrected as shown below:

Column 9,
Line 62, please change "a bolt inserted though the muffler" to -- a bolt inserted through the muffler --

Signed and Sealed this

Twenty-sixth Day of March, 2002

*Attest:*

*Attesting Officer*

JAMES E. ROGAN
*Director of the United States Patent and Trademark Office*